US005687435A

United States Patent [19]

Dufresne

[11] Patent Number: 5,687,435

[45] Date of Patent: Nov. 18, 1997

[54] SPACE SAVER PLATFORM HIDING BED AND STORAGE

[76] Inventor: Amy L. Dufresne, 77 Bismark St., Manchester, N.H. 03102

[21] Appl. No.: 628,318

[22] Filed: Apr. 4, 1996

[51] Int. Cl.[6] ..... A47B 83/00

[52] U.S. Cl. ..... 5/10.1; 5/2.1; 312/235.2

[58] Field of Search ..... 5/2.1, 3, 5, 308, 5/10.1; 312/235.2, 235.9, 235.4, 249.3

[56] References Cited

U.S. PATENT DOCUMENTS

| | | | |
|---|---|---|---|
| 1,402,607 | 1/1922 | Hickman | 5/3 |
| 3,858,253 | 1/1975 | Lauzon | 5/2.1 |
| 4,180,878 | 1/1980 | Howell | 5/3 |
| 4,259,755 | 4/1981 | Hollander | 5/2.1 |

FOREIGN PATENT DOCUMENTS

| | | | |
|---|---|---|---|
| 194398 | 9/1986 | European Pat. Off. | 5/2.1 |
| 3410918 | 10/1985 | Germany | 5/2.1 |
| 194555 | 3/1923 | United Kingdom | 5/3 |

*Primary Examiner*—Flemming Saether

[57] ABSTRACT

A space saver platform hiding bed assembly comprises a plurality of sidewall support members (20) (22) (24) and (26) of rigid material which can support weight. Such members are supported by a floor (F) in spaced angled relation with one another extending upwardly to form an open top and affixed by screws (30) to generally form a rectangular shape for suitably housing at least a mattress. A cover (28) of rigid material which can support weight is pivotally joined by a flexible device (32) to one of the sidewall support members to open for a human to sleep and to close for a human to work, entertain and play. The structure can be made in a variety of other styles, including a single bed, and a double bed and storage assembly.

20 Claims, 4 Drawing Sheets

SPACE SAVER PLATFORM HIDING BED AND STORAGE

BACKGROUND

1. Field of Invention

This invention relates to bed and storage structures, specifically to bed and storage structures for the purpose of saving space and maximizing floor space.

2. Description of Prior Art

Furniture and department stores commonly supply consumers with bed and storage structures for the purpose of sleeping and storing personal items. This is a necessary luxury in every household. If family size increases, the space in which they live does not unless they endure the cost of moving.

Trends in furniture emphasize the need for a more space efficient bed and storage structure. Beds come in a variety of sizes, such as twin-sized, full-sized, queen-sized, and king-sized. This makes space a problem in a smaller sized room and for a larger sized family. This problem is partially solved by the introduction of other beds for the purpose of saving space. However, there are still significant problems.

A platform bed is shown in U.S. Pat. No. 4,106,138 to Murphy (1977) but it does not utilize the space in which it rests except for the purpose of sleeping. It is suitable only for one per room, unless the room is of a very large size. This does not make it feasible for the larger sized family. A trundle-type bed is shown in U.S. Pat. No. 3,633,224 to Miller (1970). Miller's bed provides double the bed but it does not utilize the floor space in which it rests. The pillow and bedding must be removed in order to push the bottom bed under the top bed which does not allow much height. A bunkbed is shown in U.S. Pat. No. 4,896,385 to Bustos (1988) and is popular with families having two or more children. However, such a bed poses a hazard to young children due to the height of the top bunk.

Still, with all conventional beds, the cost of purchasing bedding can get very high to the consumer to keep up with trends and bedmaking can be very time consuming for keeping the room appearance neat. Thus, the consumer searches for more space, time, and cost efficient bed and storage structure.

OBJECTS AND ADVANTAGES

Accordingly, several objects and advantages of my invention are:

(a) to provide a bed and storage assembly which utilizes floor space most efficiently;

(b) to provide a bed which rests on a floor and thereby is safe for young children;

(c) to provide an enclosure for maximizing space for suitably housing a mattress, whether twin-sized, full-sized, queen-sized, or king-sized, so as not to lose the comfort provided by the larger sized mattress;

(d) to provide a housing for suitably enclosing multiple mattresses to accommodate a larger sized family without the loss of floor space;

(e) to provide the option of saving money so that the consumer will not need to update outdated bedding as frequently as with a conventional bed;

(f) to provide the consumer with the option to eliminate bed making;

Further objects and advantages are to provide a bed and storage assembly which can be used easily and conveniently, in which a cover that can support weight can open and close to conceal at least mattress and personal items while creating available space for work, entertainment, and play, which provides storage while eliminating the lost space associated with conventional storage containers, which is inexpensive to manufacture, which makes replacement of damaged pieces feasible without requiring the purchase of a complete new structure; which can be supplied in various sizes, colors, and shapes, which can be constructed of various materials, and which will have a broad market for home, apartment, and office use.

Thus, the availability of my bed and storage assembly will provide consumers with the option to utilize floor space most efficiently. Still further objects and advantages will become apparent from a consideration of the ensuing descriptions and drawings.

DRAWING FIGURES

In the accompanying drawings.

SUMMARY

The space saver platform hiding bed and storage assembly comprises a plurality of sidewall support members of rigid material which can support weight. Such members are joined together and are supported by a floor in angled spaced relation with one another extending upwardly to form a rectangular shape for suitably housing at least a mattress. A cover of rigid material which can support weight is pivotally joined to one of the sidewall support members to open for a prone human to sleep and to close for a human to work, entertain and play.

DESCRIPTION—FIGS. 1 TO 5

Figure 1:
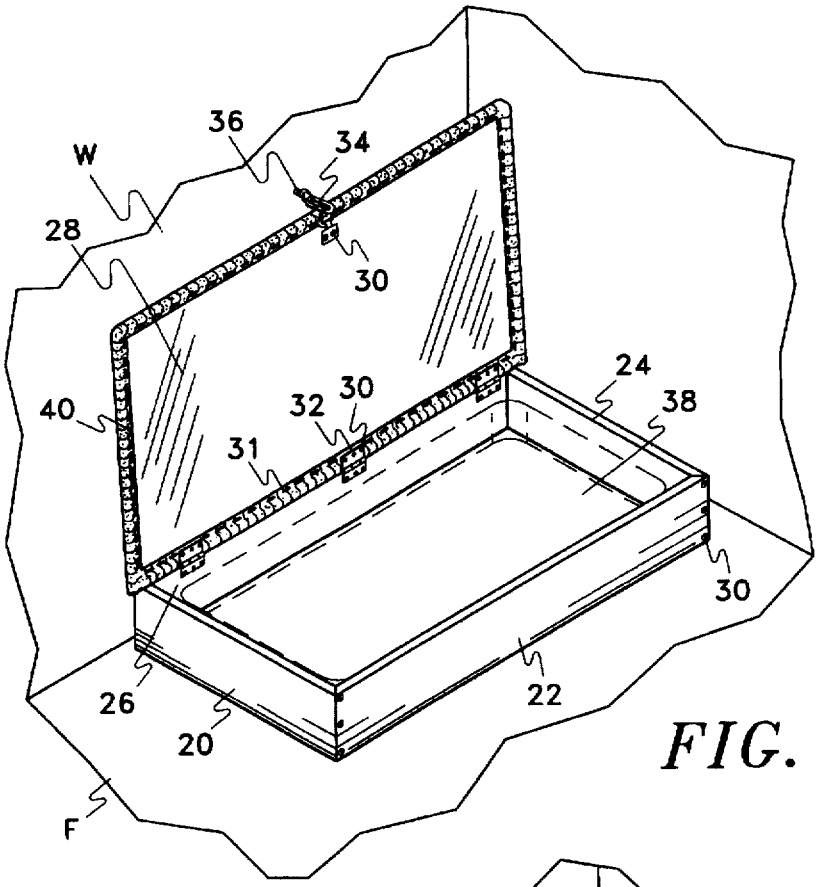
FIG. 1 is a perspective view of a single style space saver platform hiding bed assembly in accordance of my invention in an opened position.
Figure 4:
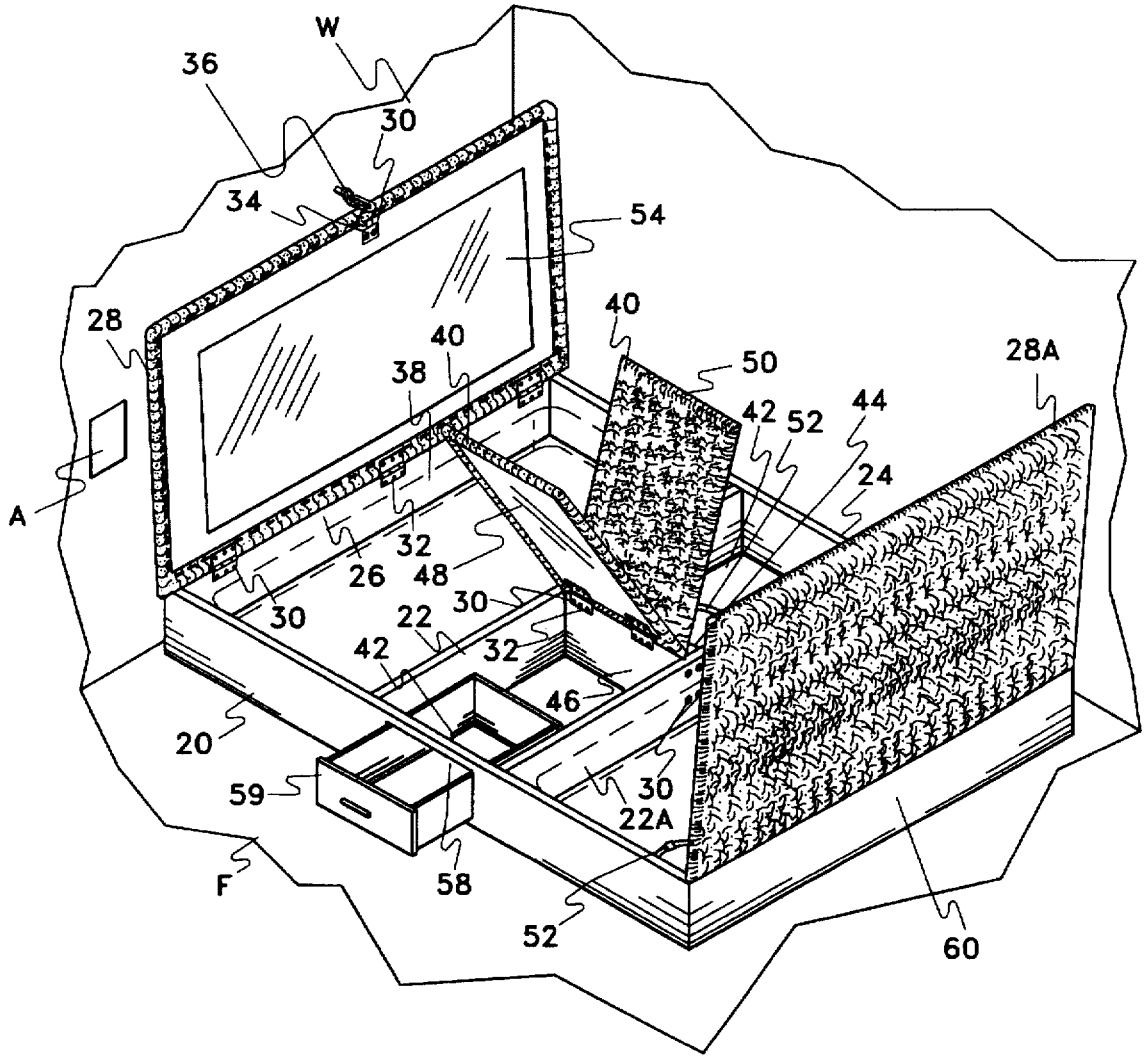
FIG. 4 is a perspective view of a double style space saver platform hiding bed and storage assembly in accordance of my invention in an opened position with additives on the interior.

The space saver platform hiding bed and storage assembly of the present invention may be employed to produce various styles of bed and storage structures as shown in FIGS. 1 and 4.

The single style space saver platform hiding bed assembly in FIG. 1 of the drawings shows a plurality of predetermined sidewall support members 20, 22, 24, and 26, typically made of rigid wood which can support weight. These members are themselves supported by a floor F in angled spaced relation with one another extending upwardly to form an open top. Such members are affixed by a plurality or screws 30 or other suitable joining techniques to form a generally rectangular shape for suitably housing a mattress 38 illustrated in phantom lines in FIG. 1.

A cover 28, typically made of rigid wood which can support weight and is approximately 7.62 centimeters wider than the rectangular shape. Cover 28 is mounted on sidewall support members 20, 22, 24, and 26 by a flexible device 32 or other suitable hinging techniques. Flexible device 32 is affixed by screws 30 or other suitable joining techniques to the underside outer wall in spaced locations of cover 28 to the inner top wall of sidewall support member 26. This covers the opening of sidewall support members 20, 22, 24, and 26 with approximately 7.62 centimeters overhanging from the outer edges of the sidewall support members. Cover 28 includes a fastening means 34, preferably a hook with a locking lip affixed by screws 30 or other suitable joining techniques to the underside outer wall of cover 28 which is opposite from flexible device 32 as shown in FIG. 1.

Thus, cover 28 may be positioned in close proximity to an adjacent wall W for fastening means 34 to be attached to an eye screw 36 that is fastened to wall W as shown in FIG. 1. This affords a variety of options for a variety of different situations.

Figure 2:
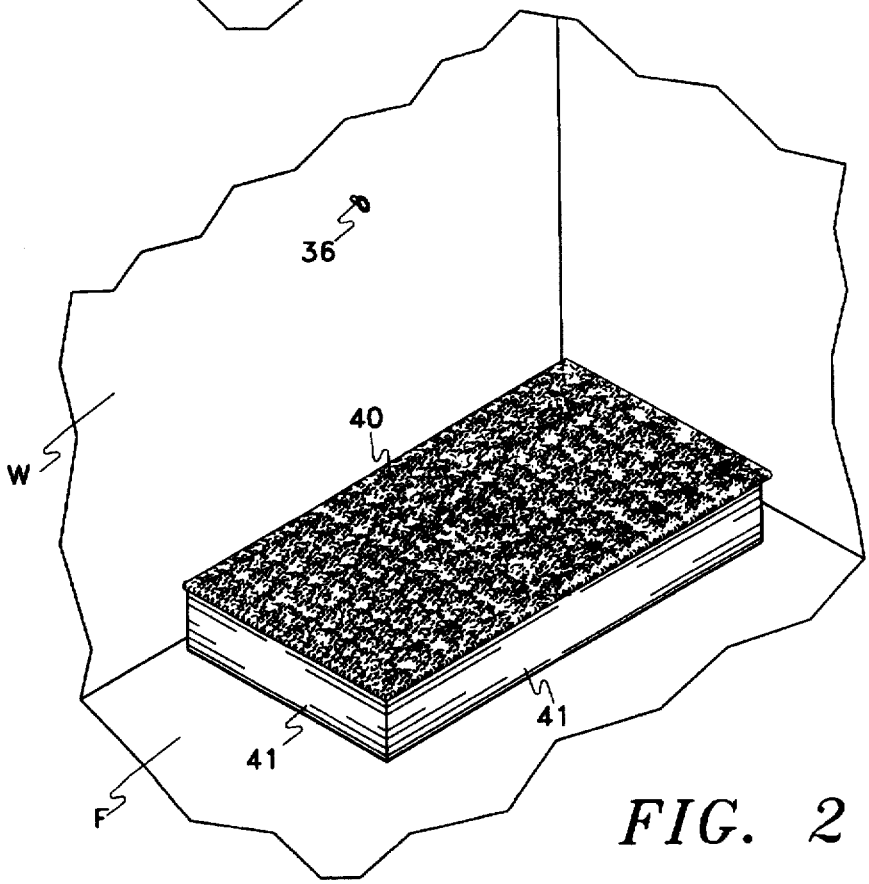
FIG. 2 is a perspective view of the single style space saver platform hiding bed assembly in a closed position with additives on the exterior.

The single style space saver platform hiding bed assembly in FIG. 2 embodies all of FIG. 1, but is shown in the closed position. It also includes an external covering 40, preferably carpet and with optional padding (not shown) in the drawing. The external covering is placed on the outer side of cover 28 and envelopes to the inner side and is affixed by a plurality of staples 31 or other suitable affixing techniques to the underside outer wall of cover 28 as illustrated in FIG. 1.

FIG. 2 also shows an external sidewall covering 41, preferably being colored laminated wood. It is affixed individually to the outer side wall of side wall support members 20, 22, 24, and 26. It is releasably joined by a hook-and-loop fastener 33 (not shown) or other suitable joining techniques and placed in spaced locations to the inner side of external sidewall covering means 41 and the outer side of sidewall support members 20, 22, 24, and 26.

Figure 3:
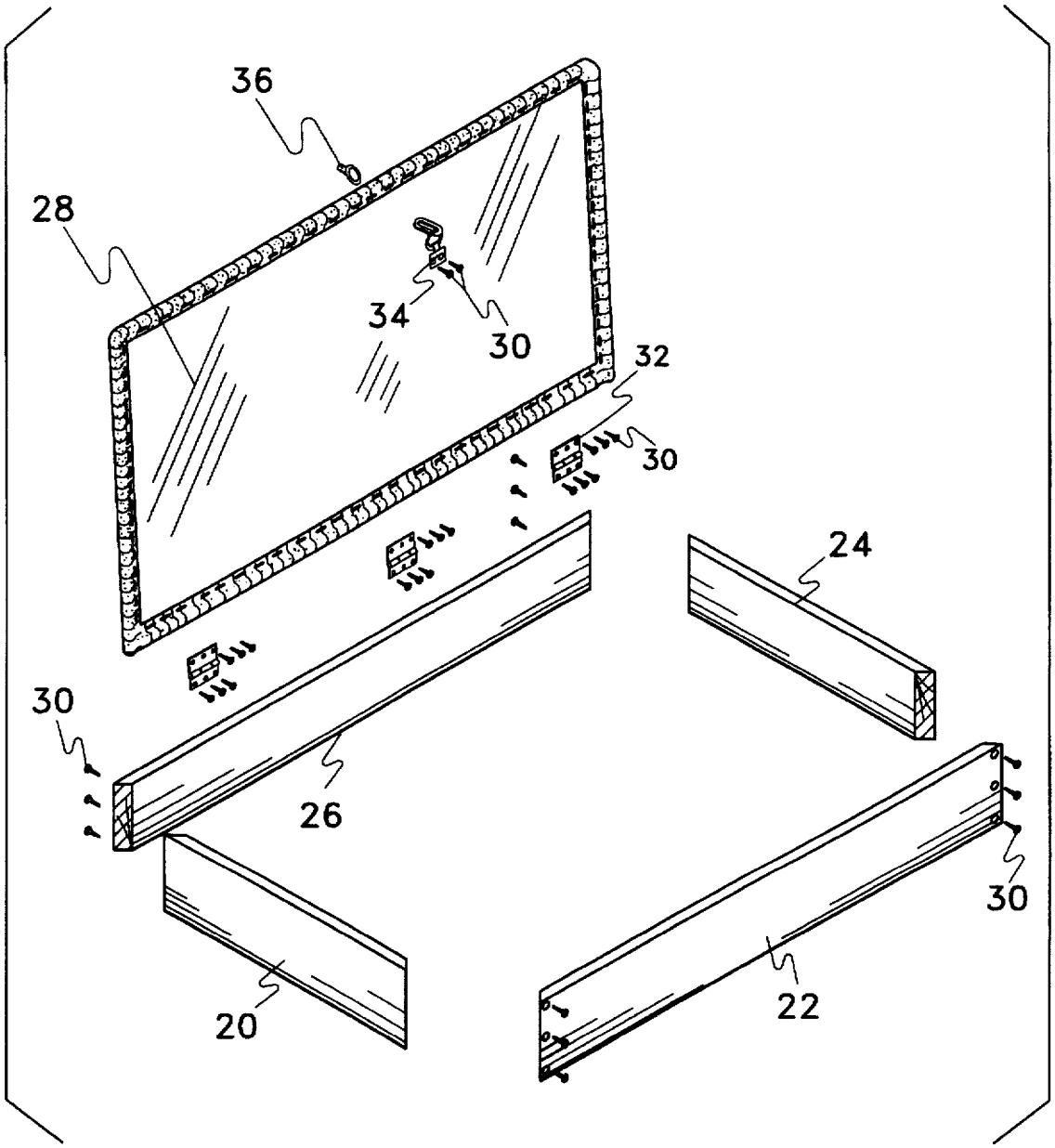
FIG. 3 is a plan view of the bed in FIG. 1 which indicates the manner in which the space saver platform hiding bed assembly is assembled and disassembled, and, in which the individual parts may be isolated for packaging and shipment.

The single style space saver platform hiding bed assembly in FIG. 3 shows how each individual piece is assembled and disassembled as per FIGS. 1's explanation.

Figure 5:
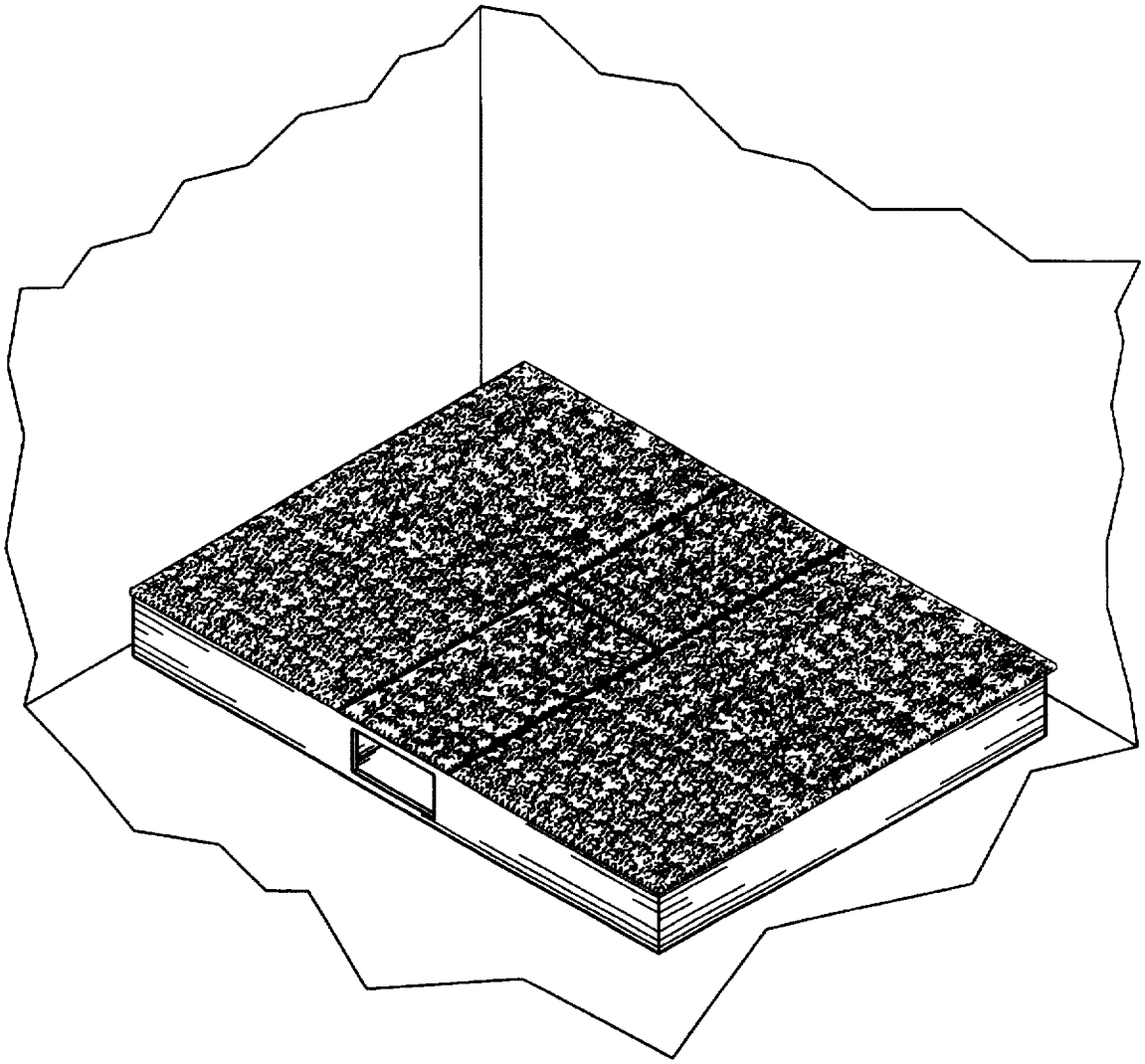
FIG. 5 is a perspective view of the double style space saver platform hiding bed and storage assembly in a closed position.

Referring lastly to the double style space saver platform hiding bed and storage assembly in FIGS. 4 and 5 of the drawings embodying all of FIGS. 1 and 2. However sidewall support members 20 and 24 are longer to accommodate a storage area 42 having an open top and a mirrored single style space saver platform hiding bed assembly 60.

Storage areas 42 has a sidewall support member 44 and 46 typically made of rigid wood which can support weight. Member 44 and 46 are centered back-to-back between sidewall support members 20 and 24. Such members act as dividers of storage area 42 and are affixed by screws 30 or other suitable joining techniques to the inner wall of sidewall support member 22 and a sidewall support member **22*a* to the short side outer edge of members 44 and 46**.

Storage area 42 has a cover 48, typically made of rigid wood which can support weight. Such cover is approximately 2.54 centimeters smaller than storage area 42 in order to take the overhang of cover 28 and a cover **28*a* into account. Cover 48 is mounted by flexible device 32, preferably hinges and affixed by screws 30 or other suitable joining techniques to the inner top wall of sidewall support member 46 in spaced locations to the underside outer wall of cover 48. Thereby to cover the opening of half storage area 42**.

Storage area 42 has a cover 50, typically made of rigid wood which can support weight. Such cover is approximately 2.54 centimeters smaller than storage area 42 in order to take the overhang of covers 28 and **28*a* into account. Cover 50 is mounted by flexible device 32, preferably hinges (not shown) and affixed by screws 30 (not shown) or other suitable joining techniques to the inner top wall of sidewall support member 44 in spaced locations to the underside outer wall of cover 50. Thereby to cover the opening of half storage area 42**.

Cover 48 and 50 both having the same external covering 40 as illustrated in FIG. 2 and previously described.

There are other optional features for appearance, convenience, and safety as shown in FIG. 4. A locking hinge 52 is affixed by screws 30 (not shown) or other suitable joining techniques to the underside outer wall both sides of cover **28*a* to the inside top of sidewall support members 20 and 24. The same can be done to any other cover if desired which can eliminate fastening means 34 and eye screw 36. Cover 28 has an interior covering 54, preferably vinyl affixed by hook-and-loop fastener 33 (not shown) to the underside of cover 28 and the inner side of interior covering 54. The same can be done to covers 48, 50, and 28*a***.

The space saver platform hiding bed and storage assembly has means for automated operation A, preferably electrical as shown in FIG. 4. It is connected to a conventional electrical outlet (not shown) for automated operation of covers 28, 48, 50, and **28*a*** to open and close.

Lastly a hole 58 generally rectangular shaped is cut into sidewall support member 20 of storage area 42 leaving an outer edge approximately 7.62 centimeters around hole 58. Thereby to provide an opening for a drawer as shown in FIG. 4.

The space saver platform hiding bed and storage assembly as shown in FIG. 5 embodies all of FIG. 4 but is shown in the closed position.

OPERATION—FIGS. 1,2,4,5

The manner of using the space saver platform hiding bed and storage to conceal and expose mattress and storage items is of a simple nature. To open covers 28, 48, 50 and **28*a* individually, namely, one first grasps onto the overhanging edge of the covers opposite side from flexible device 32. Then lifting in an upwardly motion until the covers are in an upright position as shown in FIGS. 1 and 4**.

Then depending on the situation there are different options for keeping covers 28, 48, 50, and **28*a* in the upright position. One option is fastening means 34. Whereby one grasps the hook and pushes the lip in while clicking it onto eye screw 36 which makes it difficult for a young child to operate. To disengage fastening means 34 one grabs the hook and pushes the lip in while detaching it from eye screw 36**.

Another option for keeping covers 28, 48, 50, and **28*a* in the upright position is locking hinge 52. It engages automatically when the covers are lifted upright. To disengage locking hinge 52 one pushes in at the center in an outwardly manner opposite direction of where flexible joint 32** is located. Thereby enabling one to close the covers. Operation of fastening means will vary depending on various fastening and locking hinge techniques available on the market.

The manner of closing covers 28, 48, 50, and **28*a* individually, namely, one first grasps onto the overhanging edge of the covers opposite of flexible device 32 side. Then lowering in a downward motion until covers 28, 48, 50, and 28*a*** are in a closed position.

For automated operation to open and close the covers, one uses the automated means which automatically lifts and opens the covers and lowers and closes the covers.

SUMMARY, RAMIFICATIONS, AND SCOPE

Accordingly, the reader will see that the space saver platform hiding bed and storage assembly in the single style and double style with storage provides a sleep area which can easily be converted to a floor area, thereby to accommodate use for work, entertainment, and play and to utilize space most efficiently.

In addition, my bed will save the consumer considerable time and money by eliminating the need for bed making and purchasing bedding when putting the cover down to give the appearance of a neat, uncluttered room.

Many other variations are possible. For example, the frame and cover can have other shapes, such as square, rectangular, circular, oval, triangular, etc. the frame and cover can have other sizes, depending upon use, which can include different styles such as a twin-sized, twin-sized with storage, full-sized, full-sized with storage, queen-sized, queen-sized with storage, king-sized, king-sized with storage or the combination of depending on the needs of the consumer. The height can be approximately 20.32 centimeters higher or lower depending on use. It can be constructed of wood, plastic, fiberglass or metal. The cover can have other decorative appearances other than carpet such as finished wood, tile, linoleum etc., in addition when the cover is in the upright position it can have a picture on the inside to give it a nice finished appearance. It can have automated operation for easier opening and closing of the cover(s). It can have additional cover safety features mountable to the wall. It can be positioned where desired for a variety of options and it can have drawers instead of storage covers or the combination of both.

While my above description contains specificities, these should not be construed as limitations on the scope of the space saver platform hiding bed and storage, but rather as an exemplification of one preferred embodiment thereof.

Thus, the scope of the space saver platform hiding bed and storage should be determined by the appended claims and their legal equivalents, rather than by the examples given.

What is claimed is:

1. An article of furniture for enclosing a mattress comprising:

(a) a housing having a plurality of sidewall support members extending upwardly from a floor to form an enclosure having an open top, (b) a cover mounted on said housing for closing said open top, (c) means for joining said plurality of sidewall support members together at angles to form said housing, (d) a flexible device for pivotally joining said cover to one of said sidewall support members, and (e) an external covering for said cover, (f) said sidewall support members and said cover comprising rigid material that can support a predetermined weight, (g) said external covering made of carpet material stationarily fixed to an outer side of said cover and enveloping to an inner side of said cover and fastened thereto.

2. The article of furniture in claim 1, said flexible device being a hinge.

3. The article of furniture in claim 1, said external covering being fastened to said inner side of said cover with staples.

4. The article of furniture of claim 1, further comprising a means for automated operation of said cover.

5. The article of furniture in claim 1, said sidewall members forming multiple enclosures within said housing.

6. The article of furniture of claim 5, further comprising a drawer in at least one of said sidewall support members.

7. The article of furniture of claim 1, further comprising an interior covering for said cover, said interior covering made of vinyl and having means for being releasably joined to an inner side of said cover.

8. The article of furniture of claim 7, said means for being releasably joined being hook and loop fastener.

9. The article of furniture of claim 1, further comprising a sidewall covering releasably attached to an outer side of said sidewall support members.

10. The article of furniture of claim 9, wherein a hook and loop fastener releasably attaches said sidewall covering to said outer side of said sidewall support members.

11. An article of furniture for housing a mattress comprising:

(a) a housing having a plurality of sidewall support members extending upwardly from a floor to form an enclosure having an open top, (b) a cover mounted on said housing for closing said open top, (c) means for joining said plurality of sidewall support members together at angles to form said housing, (d) a flexible device for pivotally joining said cover to one of said sidewall support members, and (e) an interior covering for said cover, (g) said sidewall support members and said cover comprising rigid material that can support a predetermined weight, (h) said interior covering made of vinyl and being releasably joined to an inner side of said cover by hook and loop fasteners.

12. The article of furniture of claim 11, said flexible device being a hinge.

13. The article of furniture of claim 11, said means for being releasably joined being hook and loop fastener.

14. The article of furniture of claim 11, further comprising a means for automated operation of said cover.

15. The article of furniture in claim 11, said sidewall members forming multiple enclosures within said housing.

16. The article of furniture of claim 15, further comprising a drawer in at least one of said sidewall support members.

17. The article of furniture of claim 11, further comprising an external covering for said cover, said external covering made of carpet material stationarily fixed to an outer side of said cover and enveloping to an inner side of said cover and fastened thereto.

18. The article of furniture of claim 17, said external covering being fastened to said inner side of said cover with staples.

19. The article of furniture of claim 11, further comprising a sidewall covering releasably attached to an outer side of said sidewall support members.

20. The article of furniture of claim 19, wherein a hook and loop fastener releasably attaches said sidewall covering means to said outer side of said sidewall support members.

* * * * *